US009540796B2

(12) United States Patent
Dallard et al.

(10) Patent No.: US 9,540,796 B2
(45) Date of Patent: Jan. 10, 2017

(54) GROUND ENGAGING TOOL MECHANICAL ATTACHMENT

(71) Applicant: SANDVIK INTELLECTUAL PROPERTY AB, Sandviken (SE)

(72) Inventors: Bradley John Dallard, Leeming (AU); Marten Bjorn Karlsson, Yangebup (AU); Benjamin Edward Smeaton, Perth (AU); Kamil Rogozinski, Joondana (AU)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 14/425,629

(22) PCT Filed: Sep. 4, 2013

(86) PCT No.: PCT/IB2013/001897
§ 371 (c)(1),
(2) Date: Mar. 3, 2015

(87) PCT Pub. No.: WO2014/037780
PCT Pub. Date: Mar. 13, 2014

(65) Prior Publication Data

US 2015/0211214 A1 Jul. 30, 2015

(30) Foreign Application Priority Data

Sep. 4, 2012 (AU) ..... 2012903830
Apr. 29, 2013 (AU) ..... 2013901490

(51) Int. Cl.
*E02F 9/28* (2006.01)

(52) U.S. Cl.
CPC ..... *E02F 9/2833* (2013.01); *E02F 9/2841* (2013.01); *Y10T 29/49824* (2015.01)

(58) Field of Classification Search
CPC ..... E02F 9/2833; E02F 9/2841; E02F 9/2883; E02F 9/28; E02F 9/2825; E02F 9/2866; E02F 9/2851; E02F 9/2891; Y10T 29/49824
USPC ..... 37/446, 452–458
See application file for complete search history.

(56) References Cited

U.S. PATENT DOCUMENTS 3,371,437 A * 3/1968 Wilson ..... E02F 9/2825 37/455
5,713,145 A * 2/1998 Ruvang ..... E02F 9/2833 37/455
6,729,052 B2 * 5/2004 Ollinger, IV ..... E02F 9/2825 37/452

(Continued)

FOREIGN PATENT DOCUMENTS

AU 2003204374 A1 5/2002
EP 0902132 A2 3/1999

*Primary Examiner* — Robert Pezzuto
(74) *Attorney, Agent, or Firm* — Corrine R. Gorski

(57) ABSTRACT

A connection assembly for mounting a ground engaging tool to earthmoving equipment includes a body into which is received a resilient member, a force applying member, a locking member with an O-ring seal to be received in an annular channel around the locking member, a locking member stop received in a hole in the locking member, and a body stop to be fitted into an aperture under the body. The locking member stop prevents the force applying member from rotating within the body when the bolt is rotated and advances the piston by threaded engagement.

35 Claims, 17 Drawing Sheets

(56) References Cited

U.S. PATENT DOCUMENTS 7,219,454 B2 5/2007 Maher

* cited by examiner

GROUND ENGAGING TOOL MECHANICAL ATTACHMENT

RELATED APPLICATION DATA

This application is a §371 National Stage Application of PCT International Application No. PCT/IB2013/001897 filed Sep. 4, 2013 claiming priority of AU Application No. 2012903830, filed Sep. 4, 2012 and 2013901940 filed Apr. 29, 2013.

FIELD OF THE INVENTION

The present invention relates to mechanical connection of wear parts to underlying structures. The present invention has been created in relation to the connection of ground engaging tools to buckets of earth-moving equipment.

BACKGROUND TO THE INVENTION

Ground engaging tools (GET), for earth-moving equipment, such as those used in mining operations, operate in a highly abrasive environment, are subjected to high impact forces and therefore wear out or become damaged through use. GET, such as teeth used on the front lip or edges of a bucket of the earth moving equipment, therefore require regular replacement.

Traditionally, GET are welded onto the lips of buckets. When the GET come to the end of their useful life, they can be cut from the bucket, and new GET welded in their place.

It will be appreciated that such cutting and re-welding operations are complex, time-consuming and relatively expensive. Further, they must generally be done in a workshop to ensure the cutting off and welding is done correctly, requiring the bucket to be transported away from the earthmoving equipment.

Various mechanical attachment methods have been proposed in an attempt to alleviate these problems. Many of the methods involve the use of bolts and similar fastening devices, inserted within the lip of the bucket. In general, such devices have proved to be of limited use. The insertion of a bolt or similar within a bucket lip can lead to undesirable stress concentrations within the lip, resulting in cracking of the bucket lip. Even where this is avoided, the large forces to which GET are exposed have a tendency to deform connecting bolts, thus making difficult their subsequent extraction using mechanical tools. Indeed, in some cases the deformation can be so severe that the GET must be cut away, completely negating any advantage of mechanical connection.

In response to these issues, the applicant has devised a number of mechanical connection means which overcome these problems. Examples of the applicant's devices are detailed in U.S. Pat. No. 7,219,454 and in U.S. Pat. No. 7,472,503 and in U.S. patent application Ser. No. 13/133,213 (also published as International PCT publication number WO 2010/065990), the contents of all of which are included herein by reference.

These connection means involve the use of a shroud which mounts about a lug or boss on the lip of an excavator bucket; a locking device which locates between the shroud and the boss; and the application of an external compressing force to maintain the relative position of the shroud, locking device and boss.

Although these connection means have proved far less susceptible to deformation than previous mechanical connectors, there have nonetheless been occasions where the connection means have had one or more problems. Sometimes failure of the GET or connection means can occur when the GET is in use due to a load being applied which is higher than the means can bear. The number of individual components forming the connection means can make fitting/refitting a GET time consuming. Other times, when it is necessary to remove the GET, the connection means is troublesome to undo to release the GET from the bucket, or, even if the connection means is released, the GET does not readily remove from the bucket lip, usually because of dirt and/or deformation of the connection means and/or GET preventing removal.

The present invention seeks to provide a means by which removal and preferably application of the GET to earthmoving equipment can be substantially improved.

SUMMARY OF THE INVENTION

In accordance with a first aspect of the present invention there is provided a connection means to releasably attach a ground engaging tool (GET) to earth moving equipment, the connection means having a body, a force applying member and a locking member, the locking member arranged to advance relative to the body for the connection means to retain a GET to the earthmoving equipment and to retract relative to the body when releasing the connection means, the locking member including a first portion arranged to positively engage with a member on the earthmoving equipment when the locking member retracts during connection means release.

A further aspect of the present invention provides a connection means to attach a ground engaging tool (GET) to earthmoving equipment, the connection means including an assembly of a body, a force applying member and a locking member having a first portion, the assembly to be received into a recess in the GET, wherein, in use, application of force by the force applying member causes the force receiving member to advance relative to the body and thereby to engage the device with a portion of the earthmoving equipment to apply forces to the GET and the portion of the earthmoving equipment to connect the GET to the earthmoving equipment, and the locking member including means to apply a release force to the portion of the earthmoving equipment when releasing the connection means.

In accordance with another aspect of the present invention there is provided a unitary connection means to attach a ground engaging tool (GET) to earthmoving equipment, the device having a body, a force applying member and a force receiving member, wherein application of force by the force applying member causes the force receiving member to advance relative to the body and thereby to engage the device with both the GET and a portion of the earthmoving equipment to retain the GET on the earthmoving equipment Thus, beneficially, the connection means is able to positively retract to release the GET from locking engagement with the earthmoving equipment. Known means of connecting a GET to, say, a bucket of earthmoving equipment can use a bolt type mechanical attachment mechanism, but when it comes time to release that mechanism for removal and replacement of the GET, the bolt may undo with difficulty, but the attachment mechanism doesn't retract whatever locking means is used in order to positively release the attachment mechanism to allow removal of the GET. Friction, dirt or corrosion within the mechanism can cause the attachment mechanism not to allow retraction.

The force receiving member may incorporate or be the locking member. The portion of the earthmoving equipment may include an adapter, lug or boss (hereinafter these are collectively referred to as a boss for ease of understanding) on or adjacent a lip of a bucket of the earthmoving equipment.

In use, according to one or more embodiments, an application of force by the force applying member to the locking member causes the locking member to extend from a first side of the body.

The first portion of the locking member may be provided by a channel or groove in the locking member, which may create a projection (or lip) on the locking member.

The locking member projection may engage during release of the connection means with a corresponding portion on a boss attached to the earthmoving equipment. The boss portion may be a projection extending from the boss or a face of the boss.

The locking member may include a stop means arranged to restrict or prevent rotation of the locking member during locking and/or release of the connection means. The stop means may be provided by one or more stop projections from the locking member that engages with the body to prevent rotation of the locking member relative to the body. The stop means may include a pin or key projecting from the locking member.

The force applying member may include a threaded member, such as a bolt. The locking member may include a corresponding threaded member for threading engagement with the thread of the threaded force applying member. The locking member may include a nut, which may be cylindrical externally and threaded internally. However, other forms are considered to fall within the scope of this application, such as quadrilateral, hexagonal or octagonal prism locking member (which may not therefore require the stop means.) Thus, the locking member may advance by rotation of the threaded force applying member.

The force applying member may include a stop means, which may include a shoulder or collar. The shoulder or collar may be provided along a portion of a shaft of the force applying member. This force applying member stop means may engage with a body stop portion. This body stop means may be integral to the body or may be an additional attached or fitted stop means, such as an insert, a press or interference fit key or a grub screw or woodruff key, that projects to act as a stop for the force applying member. Preferably the body stop means may include an insert into an aperture through the body, the insert projecting into a path of travel of part of the force applying means to thereby stop further travel of the force applying means in that direction.

In accordance with a third aspect of the present invention there is provided a ground engaging tool (GET) attachment system for connecting a GET to a bucket lip, the bucket lip having a boss thereon, the GET having a recess which receives the boss in use, a connection means being disposed, in use, between the boss and the GET, the connection means having a body, a force applying member and locking member including a connection means release portion, wherein application of force by the force applying member causes the locking member to travel relative to the body and to engage with the boss, and when releasing the connection means, the locking member reverses its travel and the connection means release portion applies a force to assist in releasing the GET from locking engagement with the bucket lip.

Preferably, the force applying member is slidably received in the body. The force applying member may include a portion that projects through an aperture of the body when received therein. That projecting portion may include a drive head with means to receive a driver to operate the connection means. The drive head may include an external hexagonal head or an internal socket, such as a hex drive socket for a pneumatically operated driver (e.g. a rattle gun).

It is preferred that the force applying member is substantially axially aligned with the force receiving member or locking member.

The force receiving member and/or force applying member may include a piston, and may be substantially cylindrical in shape. In a preferred embodiment, the force receiving member or locking member has a bevelled outer edge of a leading part thereof. This allows a small degree of plastic deformation of the force receiving member/locking member to occur without significantly affecting operation of the connection means.

The force receiving member/locking member may have a hardness less than 90% of the hardness of the force applying member. It is preferred that the ratio of hardness of the force receiving member to the force applying member be between 0.7 and 0.9. Testing has suggested that a hardness ratio of about 0.8 provides an efficacious result.

One or more resilient members may be provided between part of the force applying member and the body and/or between part of the force applying member and part of the force receiving member/locking member. The resilient member(s) may include Belville washers or Nordlock washers, which may have one or more inter-engaging surfaces to prevent or restrict counter-rotation of the force applying member or locking member dependent upon where the resilient members are sited within the connection means body.

The connection means may be provided as a 'cassette' or 'cartridge' in the sense that the connection means can be provided as a single preassembled device prior to mounting into a recess into the GET. The body can form an external housing for the force applying member and locking member, and the entire connection means device then be inserted as a cassette or cartridge into the recess within the GET mounted loosely on the bucket lip. The force applying member can then be actuated to tighten the GET to the lip and thereby lock the GET in place.

At least one spacer may be provided between the body and a part of the GET. The spacer may be inserted into the recess in the GET before or after the connection means is inserted therein. The connection means may be provided as an assembly of components, which may be provided, preassembled for ready placement into the recess in the GET, or may be assembled on site at the time of mounting the GET to the bucket lip and then inserted into the recess. The spacer may include a plate, preferably with an aperture therethrough. The head of the force applying member may project into or through the aperture in the spacer when assembled in place with the GET. This can allow access to the drive means on the force applying member, such as by a pneumatically actuated driver e.g. a 'rattle gun', to tighten and release the connection means.

The body may include a recessed end to allow the first portion of the locking member with the channel or recess to project from an end of the body to engage with the boss at least when releasing the connection means. The recess may be a step or opening in an end of the body.

The connection means may include a force application portion arranged to apply a release force to the GET when operating, preferably when un-tightening, the connection means.

The force applying portion may be provided by an projection on the body of the connection means.

Another form of the present invention provides a method of releasing a ground engaging tool (GET) from earthmoving equipment, the method including releasing a connection means releasably attaching the GET to the earthmoving equipment, during the releasing the connection means positively retracting together a locking member and body to contract the connection means.

The locking member may apply a force to a portion of the earthmoving equipment during the retraction. The force may be applied to a boss on a lip of a bucket of the earthmoving equipment.

During un-tightening of the connection means, the connection means may apply a removal force to the GET.

A further aspect of the present invention provides a mount for a ground engaging tool (GET) to a bucket of earthmoving equipment, the bucket including a chamfered edge, the chamfer including a surface with a boss or lug thereon, the boss or lug arranged to receive the GET and have the GET retained thereon by a connection means, the boss or lug being predominantly on the surface of the chamfer.

Preferably the boss or lug is welded to or integrally cast with the bucket lip.

The chamfer may be provided at an angle of 10° to 20°, preferably around 15° such that the surface of the chamfer for the boss or lug extends between 150 mm and 250 mm, preferably around 200-220 mm., back from a leading edge of the lip. Thus, the boss or lug can be predominantly on the chamfered surface without needing to extend onto the flat surface of the bucket. This helps reduce the height profile of the boss or lug, and therefore allows for a lower profile GET as well as enhances a straight line offering of the GET onto the boss or lug.

A further aspect of the present invention provides a method of releasing a connection means prior to removing a ground engaging tool (GET) from earthmoving equipment, the connection means including a force applying member, a locking member and a body, the method including:

releasing the force applying member from a force applied state to a force relieved state and at least partially retracting the locking member, removing a spacer from between the connection means and the GET, moving the body to at least partially occupy space created by said removal of the spacer, at least partially inserting a release member into a space created between the body and the GET by said moving the body at least partially into the spacer space, actuating the force applying member to at least partially retract the locking member into the body and, by relative movement of the locking member with respect to the body, cause the body to apply pressure via the release member to the GET to assist in releasing the GET from the earthmoving equipment.

Thus, advantageously, the connection means can be used to help remove or loosen the GET which can, after prolonged work use, become wedged onto the lip of the earthmoving equipment, such as by fines of material filling crevices in and around the get or by distortion of the material of the GET, the boss or the lip of the earthmoving equipment.

Furthermore, actuating the force applying member can allow the locking member, which is engaged with a portion of the boss, to retract into the body, such that the locking member and body move relative to one another. Because the locking member is engaged with the boss, the body moves forward to apply pressure to the release member inserted between the body and the rear face of the opening in the GET ahead of the body. This allows the body to 'push' the GET off the boss because the locking member e.g. the piston within a pin-block, is hooked over a lip on the boss.

Further, the reaction force of the body pushing on the GET may allow the locking member to release from engagement with a member on the earthmoving equipment and to at least partially retract the locking member into the body, thereby releasing the connection means for removal from within the GET opening. Thus, a method is provided that positively releases the connection means.

Preferably the release member includes a spacer used to the rear of the connection means. The spacer may have an aperture or recess therethrough which allows an actuation tool to be inserted through the spacer to operatively engage with the force applying member. The recess may be in the form of a 'cut-out' in the sense of a hole that opens out to a periphery of the spacer. The spacer may therefore also be used as the release member for insertion between the body and the GET to assist in removing the GET from the earthmoving equipment.

The recess in the spacer may include a central hole therethrough and an opening to the periphery that is wider than the central hole and connects to the central hole and opens to the periphery of the spacer. The wider portion at the periphery may allow the spacer to span over the locking member when the spacer is inserted ahead of the body between the body and the GET.

Preferably, the body of the connection means includes at least one projection on both sides of an upper surface of the main portion of the body, and adjacent the opening in the body where the locking member projects from. Such projections increase the frontal surface area of the body, particularly the surface area that the spacer will contact when inserted to release the GET.

The projections adjacent the frontal surface of the body may have sloping or bevelled rearward surfaces which aid in removing debris from the cavity behind projections to help move or release the body.

The force applying member may be retained in the body by a resilient retaining means, such as a circlip around a shaft portion of the force applying member. A shoulder of the force applying member at least as wide as the diameter of the resilient retaining means may contact the resilient retaining means to prevent the force applying member from withdrawal or removal from the body until the resilient retaining means is released, such as by use of a release tool.

Preferably the body has an upper surface that is externally exposed in the opening of the GET. Thus, effectively, the upper surface of the body forms part of a surface for material to flow over when the GET is in use, rather than the body being mostly or completely inserted into and protected by the GET. This allows for a reduced profile GET, which reduces material and manufacturing cost as well as smoothing the flow of material over the GET when the GET is in use.

BRIEF DESCRIPTION OF THE DRAWINGS

It will be convenient to further describe the invention with reference to preferred embodiments of the present invention. Other embodiments are possible, and consequently, the particularity of the following discussion is not to be understood as superseding the generality of the preceding description of the invention. In the drawings.

DESCRIPTION OF PREFERRED EMBODIMENTS

Figure 1:
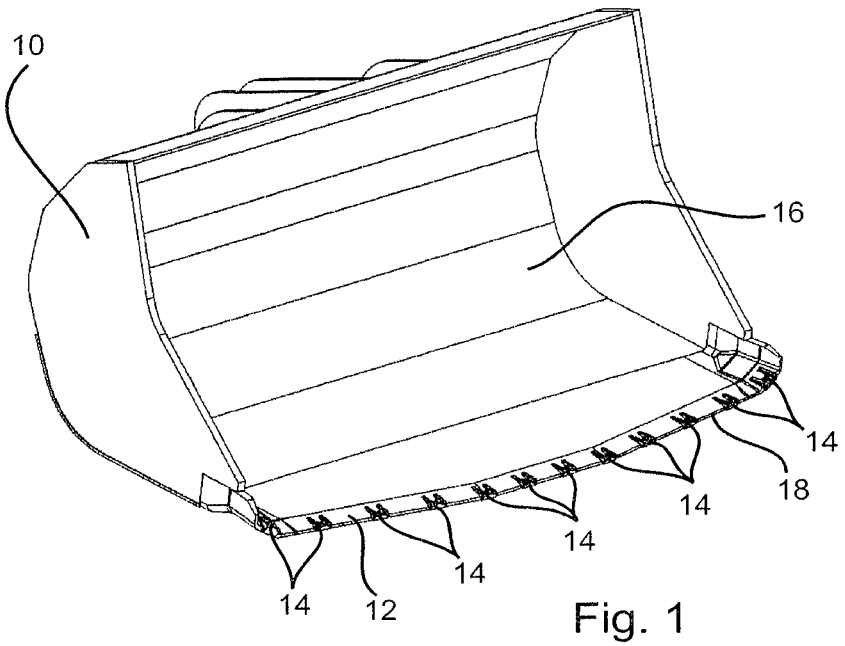
FIG. 1 shows a number of low profile bosses (also known as lugs or adapters) mounted to a front lip of a bucket of earthmoving equipment according to an embodiment of the present invention.
Figure 2:
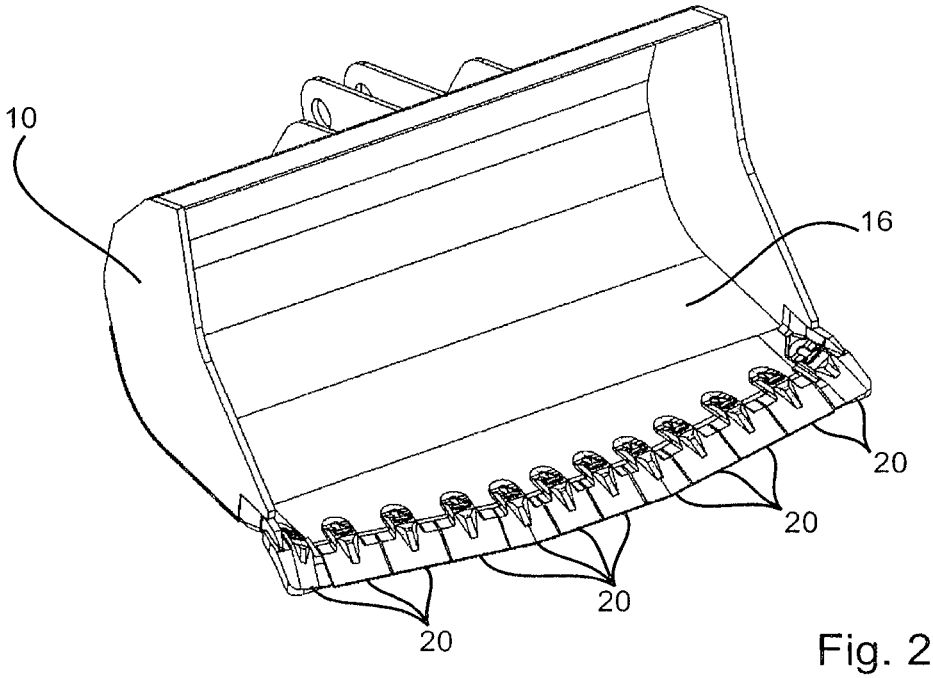
FIG. 2 shows a number of ground engaging tools (GET) attached to respective low profile bosses of FIG. 1 according to an embodiment of the present invention.

A bucket 10 of an earthmoving vehicle (not shown) has a front lip 12 with several bosses 14 (also known as lugs or adapters), each to receive a ground engaging tool. The front lip tapers from a thicker rear portion adjacent the bowl 16 of the bucket to a thinner front edge 18. Each boss fits onto the lip and extends over the front edge. Each boss is welded in place. FIG. 2 shows ground engaging tools 20, each mounted to a respective boss.

Figure 3:
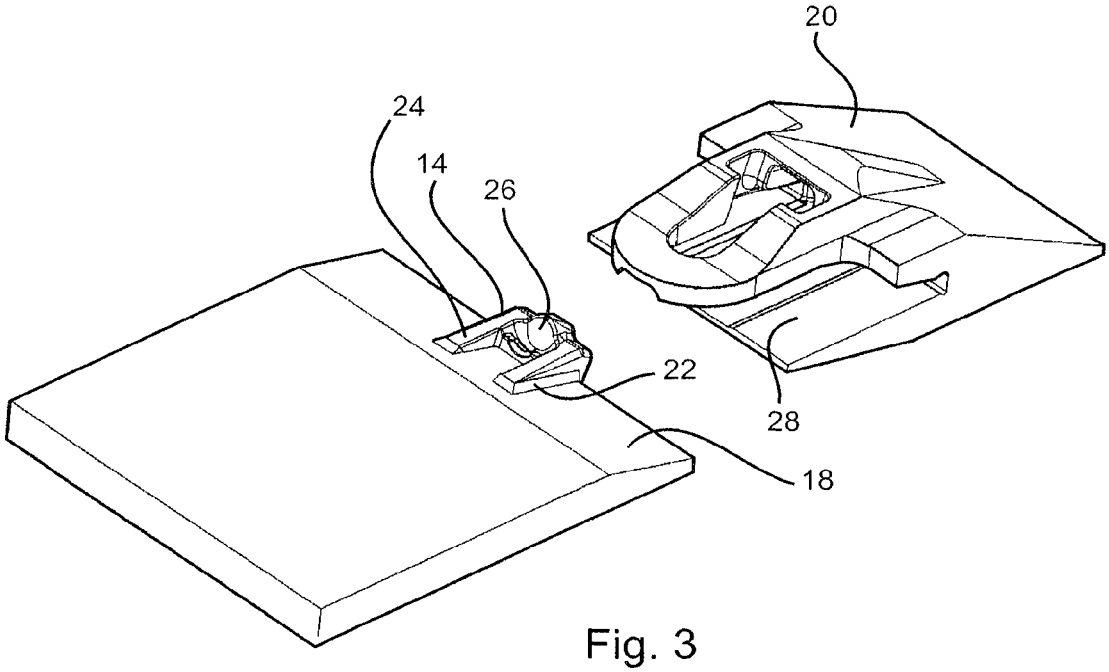
FIGS. 3 and 4 show various stages of mounting a ground engaging tool to a low profile boss according to an embodiment of the present invention.
Figure 4:
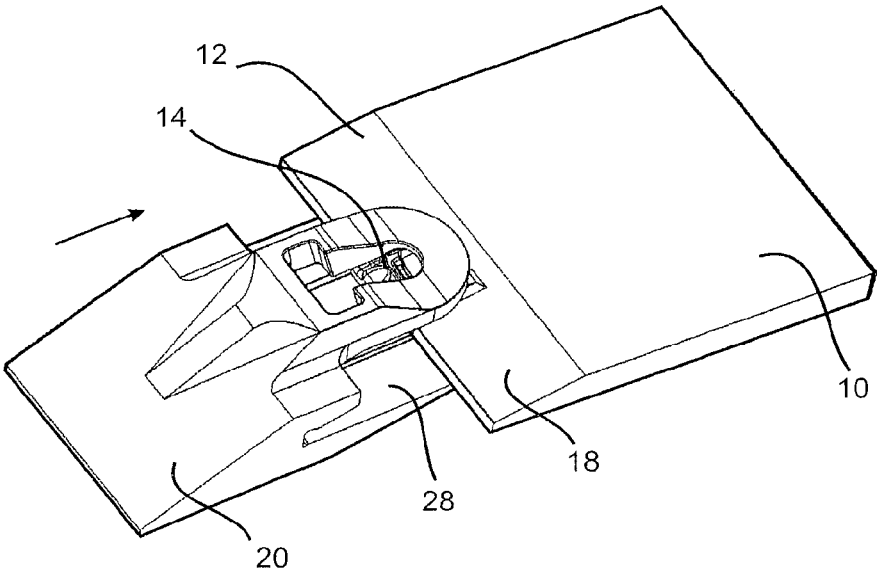

FIG. 3 shows a section of the front lip 18 of the bucket 10. The tapered edge of the lip is clearly shown. The boss 14 has two arms 22,24 extending back across the upper surface of the tapered lip. A boss contact face 26 is provided between the two arms. A GET (also known as a 'shroud' in the form shown has an opening 28 in the rear thereof so that the GET is received onto the boss. FIG. 4 shows the boss being received into the opening of the GET as the GET is mounted onto the front lip of the bucket.

Figure 5:
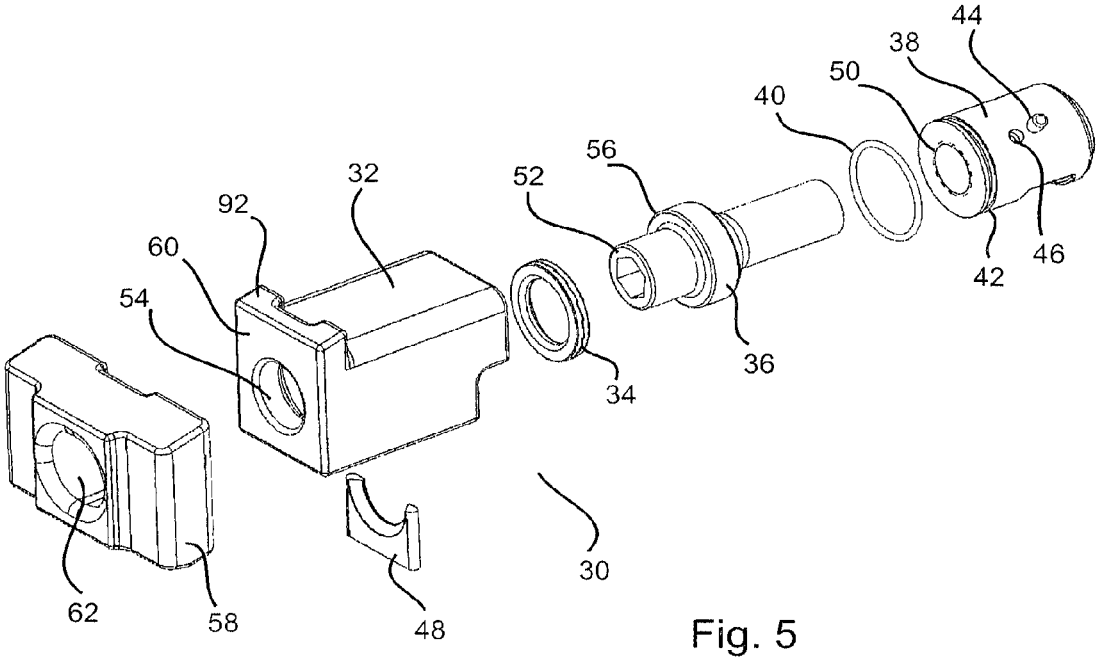
FIG. 5 shows an exploded view of a connection means and spacer according to an embodiment of the present invention.

FIG. 5 shows an exploded view of a connection assembly 30 according to an embodiment of the present invention. The connection assembly includes a body 32 into which is received a resilient means 34, a force applying member in the form of a bolt 36, a locking member in the form of a piston 38 with an O-ring seal 40 to be received in an annular channel 42 around the locking member, a locking member stop in the form of a pin 44 received in a hole 46 in the piston, a body stop in the form of a key 48 to be fitted into an aperture under the body. The pin 44 prevents the piston from rotating within the body when the bolt is rotated and advances the piston by threaded engagement therewith. The bolt has an external thread (not shown) that engages with an internal thread 50 in the piston.

For assembly of the connection means, with the O-ring and stop pin in place on the piston, the piston is initially threaded onto the bolt. The bolt is inserted head 52 first into the body with the resilient means around the head. The key 48 is inserted into an aperture under the body which prevents the bolt coming back out of the body and acts as a stop for the bolt when releasing the connection means to remove a GET. More on that later. The body has an aperture 54 giving access to the head of the bolt. In fact, it is preferred that the head of the bolt projects out of the aperture for ease of access to connect a drive means to the head of the bolt to tighten or loosen the connection means. The shoulder or collar 56 on the bolt abuts the resilient means which is therefore trapped between the interior surface of the body adjacent the aperture 54 and the collar/shoulder 56.

A spacer 58, in use, sits adjacent the rear face 60 of the body and has a spacer aperture 62 that aligns in use with the aperture 54 of the body.

Figure 6:
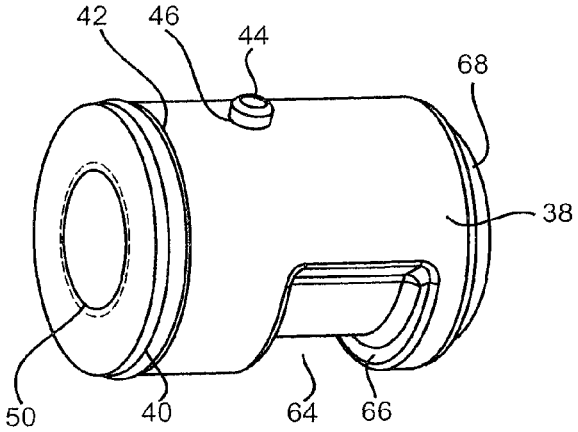
FIGS. 6 and 7 show views of a locking member of an embodiment of the present invention.
Figure 7:
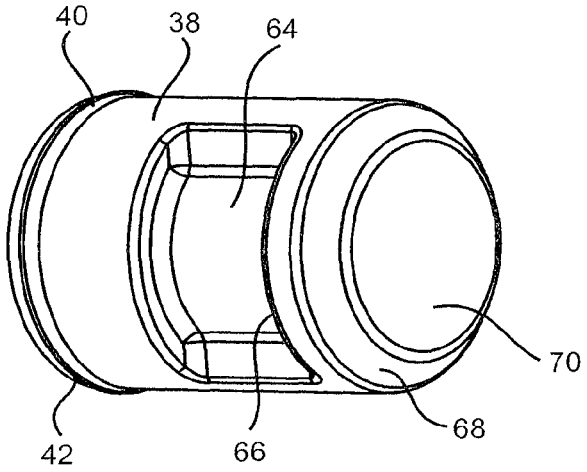

FIGS. 6 and 7 show close up views of the locking member (piston 38). The piston includes a recess 64 and a wall or lip 66 arranged to contact a reverse lip on the boss during release of the connection means. As shown in FIG. 7, the piston has a bevelled leading end 68 and a contact face 70 arranged to contact the contact surface on the boss when the connection means is tightened up. During release of the connection means, the projection 92 on the body 32 pushes against the rear edge of the opening in the GET. This helps to push the GET off the boss and bucket lip, and thereby improves removal of the GET.

Figure 8:
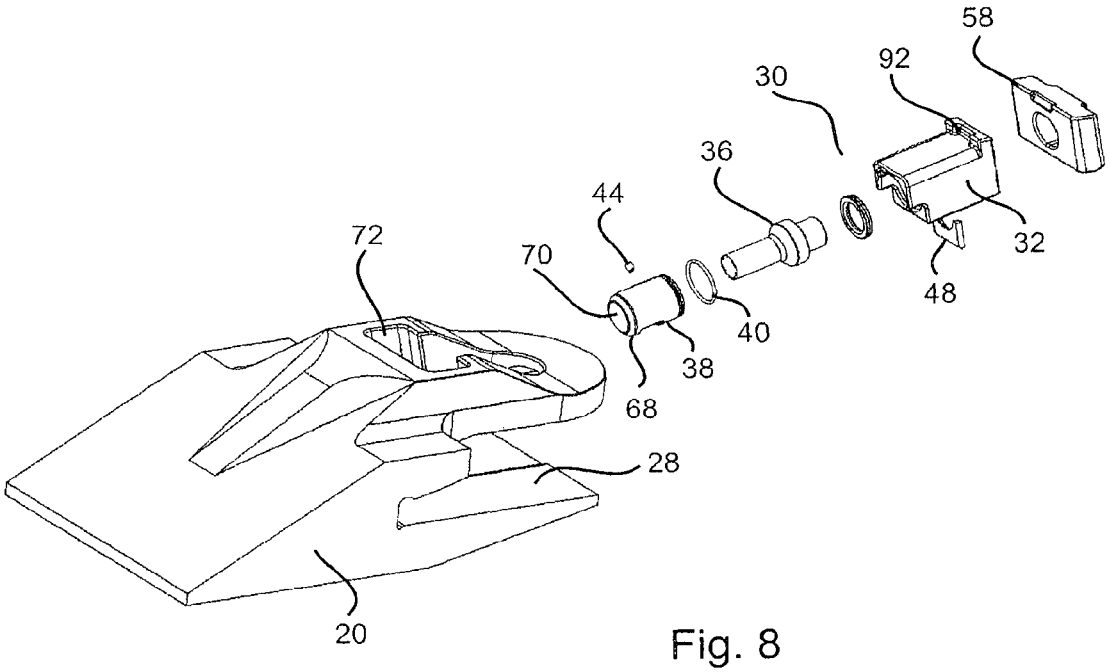
FIG. 8 shows an exploded view of a connection means and spacer prior to being received into a recess with the GET according to an embodiment of the present invention.

FIG. 8 shows the exploded connection means 30 prior to placement into the upper opening 72 to be received into a recess in the GET that forms part of the opening 28 of the GET 20.

Figure 9:
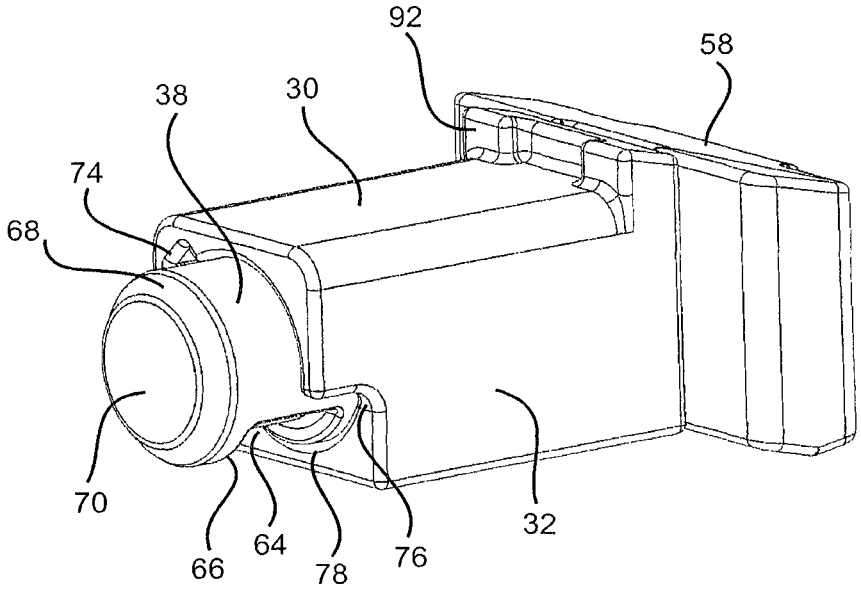
FIG. 9 shows an assembled connection means with adjacent spacer according to an embodiment of the present invention.

FIG. 9 shows the assembled connection means 30 as a cassette or cartridge with the spacer 58 behind. As can be seen, the piston 38 projects out of the body 32. The body includes a stop recess 74 to receive the pin of the piston and prevent the piston rotating when driven by the rotating bolt. The body also has a body recess or step 76 that allows the lip or wall of the piston to project sufficiently forward that a space is created between the leading end of the piston and the leading face 78 of the body. This space allows a lip or projection on the boss to extend into the space for engagement with the lip or wall of the piston when un-tightening the connection means.

By rotating the bolt to un-tighten the connection means (when the GET is to be removed), the piston contacts the lip of the boss, which retracts the bolt and piston together. The shoulder or collar on the bolt contacts the key projecting within the body which results in the body being drawn towards the piston. This action allows the connection means to contact and thereby be loosened within the recess or opening of the GET for removal therefrom.

Figure 10:
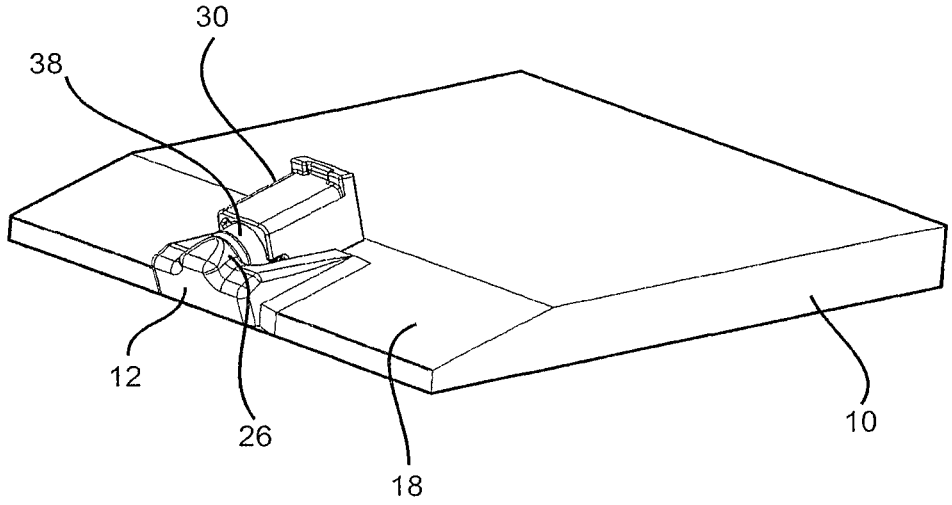
FIG. 10 shows an embodiment of the connection means abutting the boss with the GET absent in order to show the position of the connection means relative to the boss.

FIG. 10 shows an example of the assembled connection means 30 contacting the boss 14. It will be appreciated that in a real life situation the connection means will be inserted into a GET after the GET is mounted to the boss on the bucket lip. As shown, the piston 38 contacts the contact surface 26 of the boss. This enables the connection means to apply a force to the boss when tightened.

Figure 11:
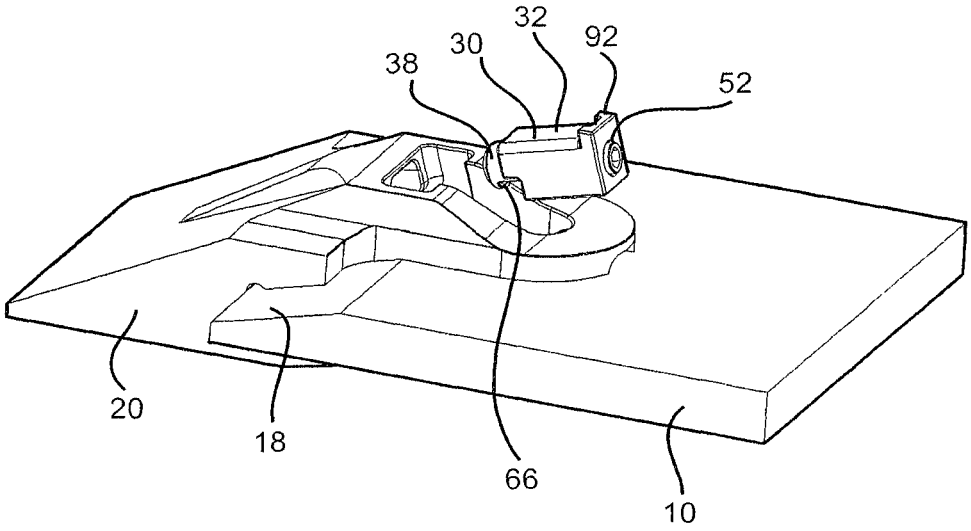
FIG. 11 shows the connection means of an embodiment of the present invention being received into the recess in the GET mounted onto a boss on the lip of a bucket.
Figure 12:
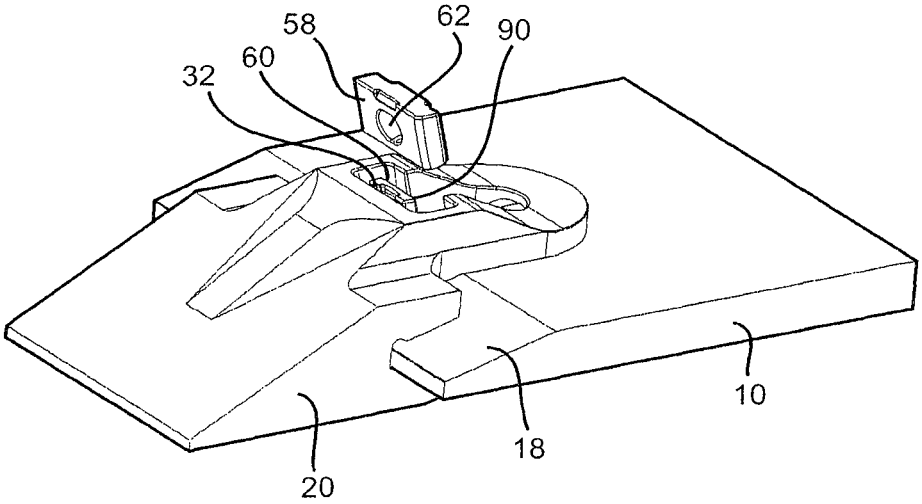
FIG. 12 shows the spacer of the connection means being received into the recess of the GET and adjacent to the rear of the body.
Figure 13:
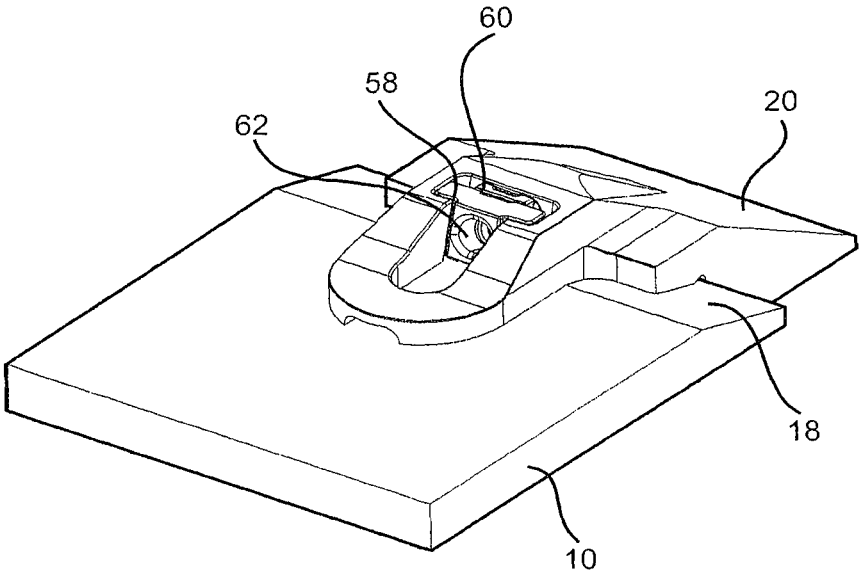
FIG. 13 shows a rear view looking at the connection means with spacer in situ according to an embodiment of the present invention.

FIG. 11 shows the connection means 30 being inserted into the recess into the GET mounted over the boss on the bucket lip. FIG. 12 shows the next step of inserting the spacer 58 into the recess behind the rear of the body 32. FIG. 13 shows a rear view of the same assembly as FIG. 12 and shows access to the aperture 62 through the spacer and hence access to the head of the bolt for tightening and loosening the connection means.

Figure 14:
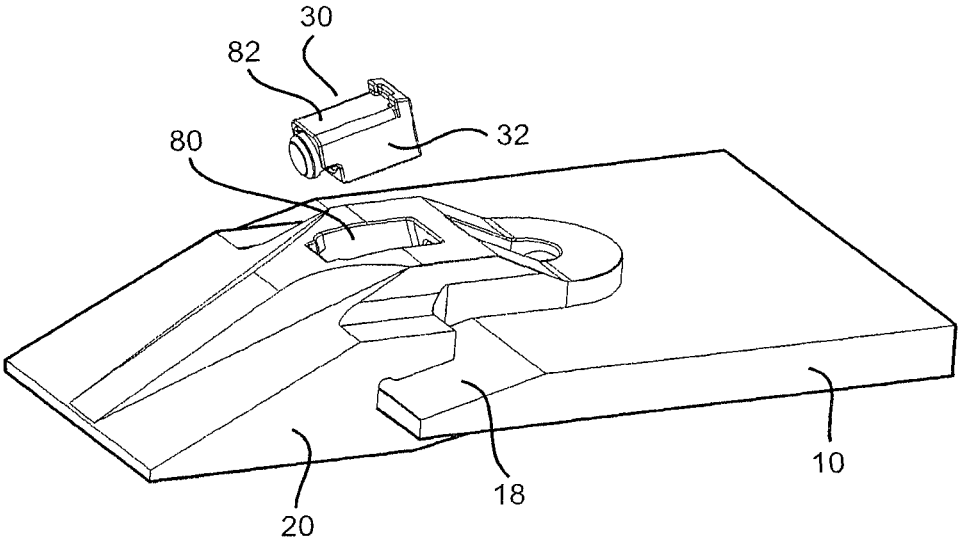
FIG. 14 shows an alternative embodiment of the connection means of the present invention that does not require a spacer.

FIG. 14 shows an alternative form of the present invention that does not require the spacer. The connection means 30 is inserted into an elongate upper opening 80 in the GET. This arrangement results in the upper face 80 of the body 32 being more exposed during use than the aforementioned embodiment (that is inserted at an angle into a shorter aperture and slides into the GET after which the spacer is put in place). However, the alternative non-spacer embodiment avoids the need for the extra spacer component which could get lost, dropped or damaged or simply forgotten about during replacement of the GET.

Figure 15:
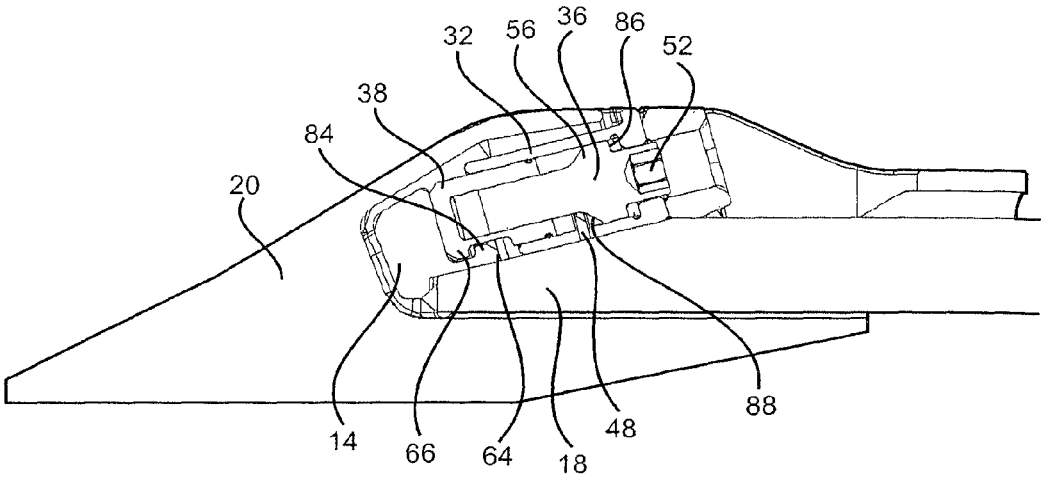
FIGS. 15 and 16 show cross sections through alternative forms of embodiments of the present invention.

FIG. 15 shows a cross section through a form of the present invention incorporating a spacer. The piston 38 contact face is shown contacting the boss contact surface, and the lip 84 of the boss is shown in the piston recess 64 so that the lip or wall 66 of the piston is able to apply a force to the boss lip 84 when the connection means is un-tightened. In doing so, the bolt advances within the body because of the threading engagement with the piston. The piston is therefore a form of nut, and hence, various shapes of the locking member (e.g. the piston) can be used. For example, a square, hexagonal, octagonal or other cross sectional shape of the locking member can be used, which may obviate the need for the stop pin because, if the body has a complementary cross sectional opening for the multi sided piston, the multi sides will prevent rotation provided the locking member is a sufficiently close fit within the body.

When un-tightening (releasing), the shoulder or collar 56 on the bolt 36, which has a flat face 86 on one side and a tapered face 88 on the other, advances because of its threaded connection to the nut (piston). The tapered face contacts the key 48 which prevents further advancement of the bolt and causes the body to move forwards due to the nut (piston) being in engagement with the boss during this loosening. The connection means therefore positively contracts.

Figure 16:
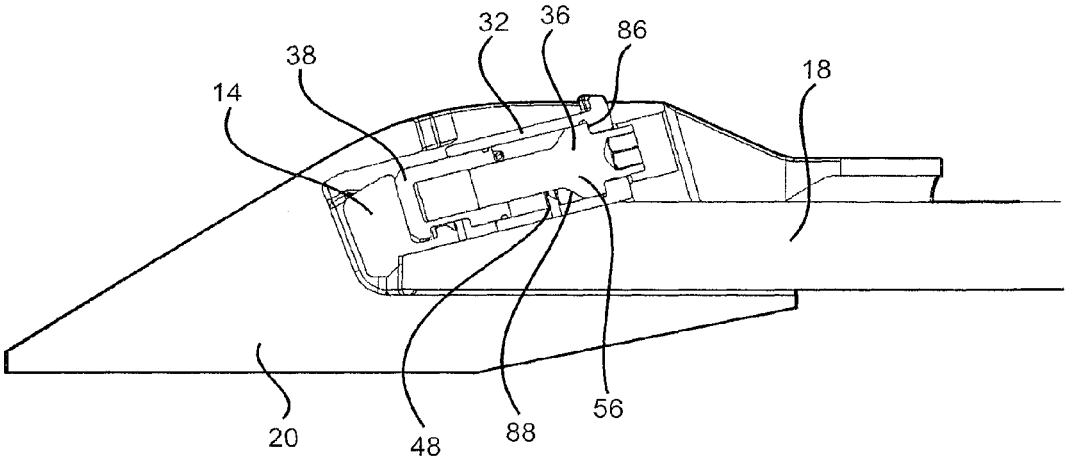

FIG. 16 shows an alternative arrangement of the spacer-less form of the present invention. No resilient means are provided between the head of the bolt and the rear interior face of the body.

Figure 17:
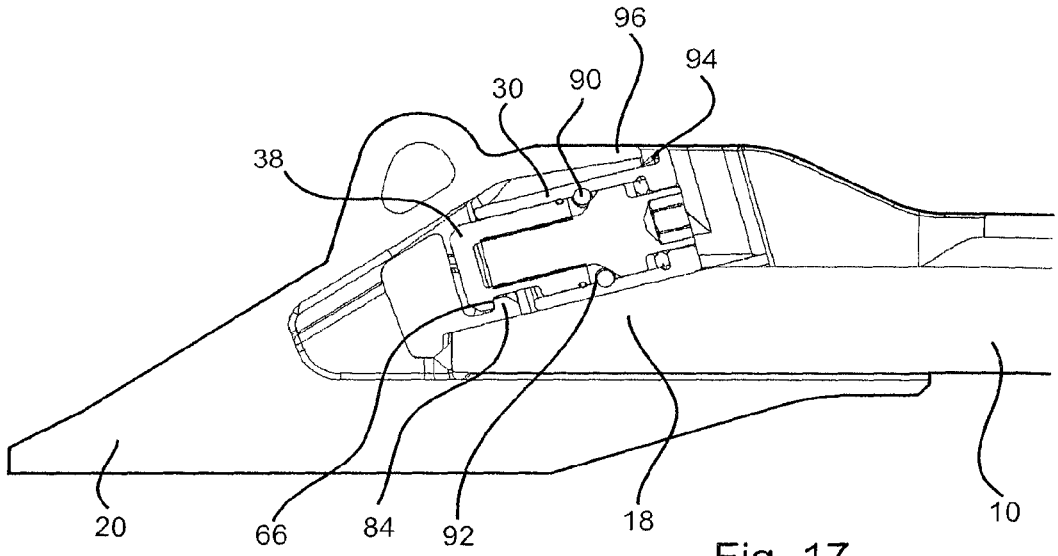
FIGS. 17 and 18 are cross sections of an embodiment of the present invention with an alternative form of stop within the body for contact with the force applying member.
Figure 18:
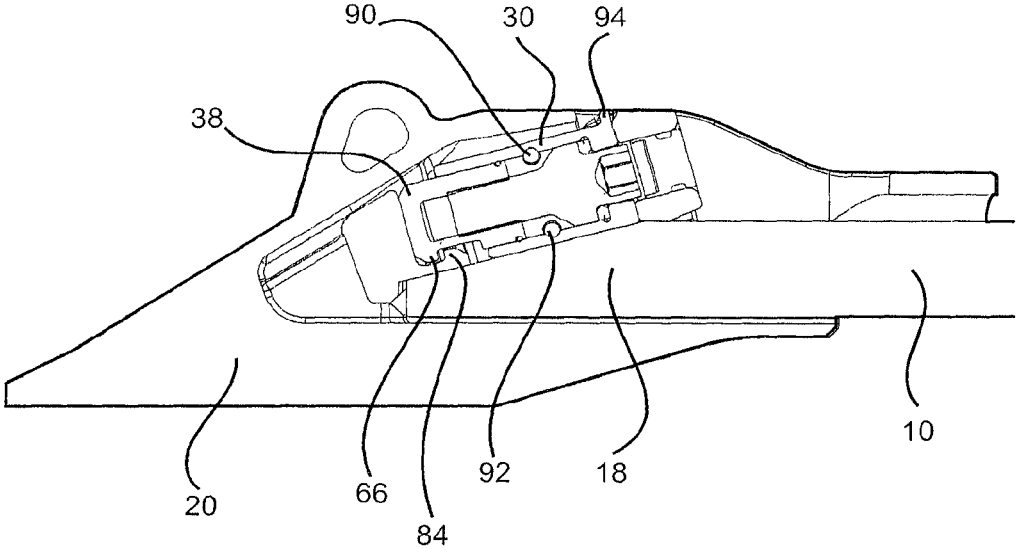

FIGS. 17 and 18 show cross sections through a GET 20 attached to a front edge or lip 18 of a bucket 10 by a connection means 30. The connection means 30 is of a similar type as used in the embodiments of FIGS. 15 and 16 that do not utilise a spacer 58. The body includes two stops 90,92 in the form of pins. When un-tightening the connection means, as shown in FIG. 17, the lip 66 of the piston/nut 38 engages with the lip 84 of the boss 14. With further un-tightening, the body is pushed towards the piston by the force applying member (bolt 36) impinging on the two pins 90,92 within the body.

When the connection means is tightened as shown in FIG. 18, the piston advances as before, and the head of the piston contacts the contact surface of the boss, thereby, with further tightening. This causes the bolt to move rearwards and thus cause the body to also move rearwards by contact of the bolt with the rear interior face of the body directly (or indirectly through the resilient means).

It will be appreciated that, when un-tightening the connection means, a projection on the body 94 can push against a portion 96 of the GET to help move the GET forwards and thereby assist with removal of the GET from the bucket lip.

The bucket lip preferably has a bevelled or chamfered face between 110 mm and 130 mm, more preferably around 120 mm. This gives a larger surface area on the bucket lip to receive the boss and allows the boss to be mounted giving a lower profile on the bucket lip. This allows the GET to have a lower profile and therefore reduces the amount of material in the GET. This also facilitates straight, single movement installation and removal of the GET.

Figure 19:
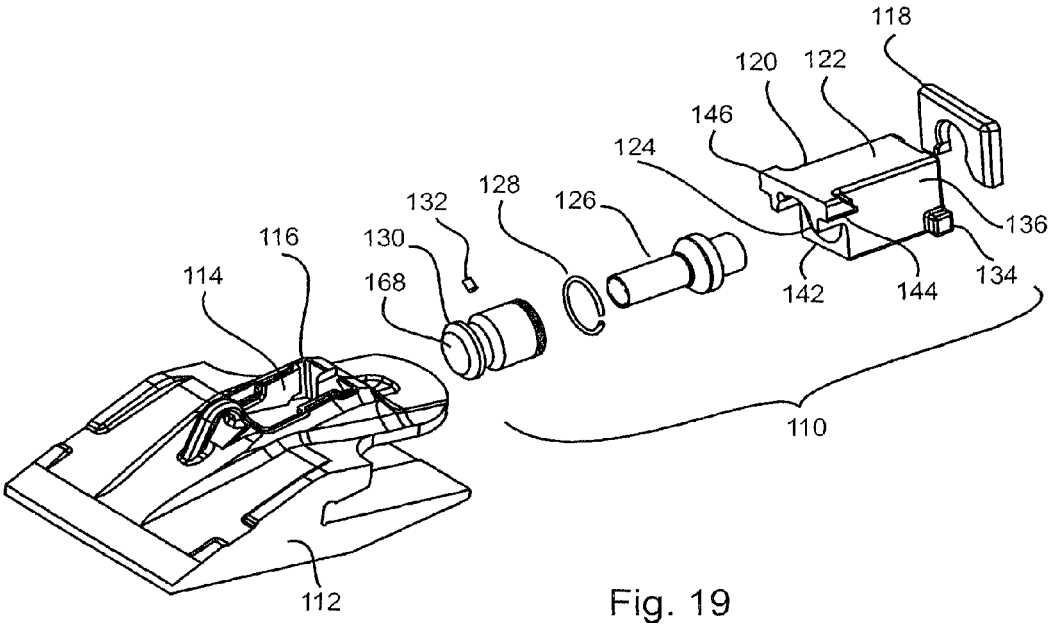
FIGS. 19 and 20 show components of a connection means in exploded views, with FIG. 19 showing a revised GET, according to an alternative embodiment of the present invention.

An alternative embodiment of a connection means 110 and GET 112 is shown in FIG. 19. The Get 112 has a lower height (lower profile) than the GET 20 shown, for example, in FIG. 3. The GET 112 has an exposed opening 114 to receive the connection means 110.

Adjacent and to the rear of the opening 114, the GET 112 includes a spacer opening 116 to receive the spacer 118 to the rear of the connection means.

It is noticeable that the body 120 of the connection means will have an exposed upper surface 122 when mounted into the opening 114 of the GET. This differs from the shielded upper surface for the connection means body in the previously described embodiments, thereby confirming the lower profile of the GET and entire assembly.

The connection means 110 includes the body 120 with an aperture 124 to receive a bolt 126. The bolt is retained inside the body by a resilient retainer 128, such as a circlip. A piston 130 threadingly engages with the bolt. The piston has a projection 132 that prevents the piston rotating when the bolt is rotated. Thus, the threaded relationship between the bolt and piston causes the piston to advance or retract relative to the body when the bolt is axially rotated clockwise or counter-clockwise.

The body 122 includes projections 134, (136 not shown) toward the lower rear of respective side surfaces 138, (140 not shown) thereof.

The leading end 142 of the body includes projections above the aperture to receive the bolt and piston. The projections help shield the piston from damage when the GET is in use and provide additional material to strength the front end of the body. The projections 144,146 include bevelled surfaces 148,150 which provide a leverage surface for a tool to pry the connection means loose if required The lower rear projections 134,136 are guided in corresponding slots or channels in the opening of the GET. Those slots or channels can also be provided as part of the opening 116 for the spacer 118, preferably with forward leading channel or slot portions from a lower end thereof to allow the body to slide forwards and lock into place once inserted into the opening.

Figure 20:
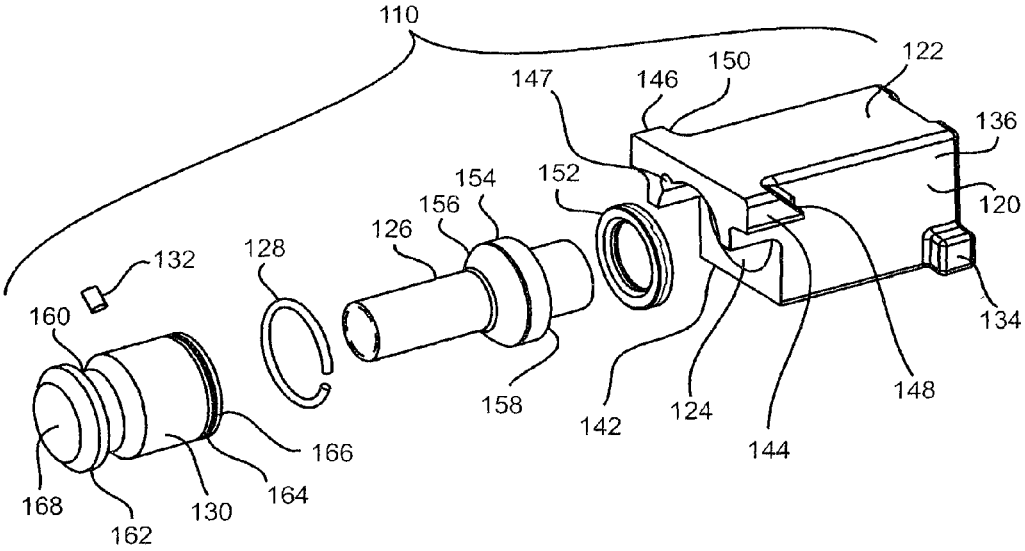

As shown in FIG. 20, a resilient means 152, such as one or more washers, can be provided behind a shoulder portion 154 of the bolt. The shoulder portion may include bevelled shoulder 156. The shoulder portion 154 provides a contact surface 158 against which the resilient means 152 can contact. The resilient means biases the bolt forwards towards the piston. The resilient retainer 128 prevents the bolt coming out of the body until released.

Figure 21:
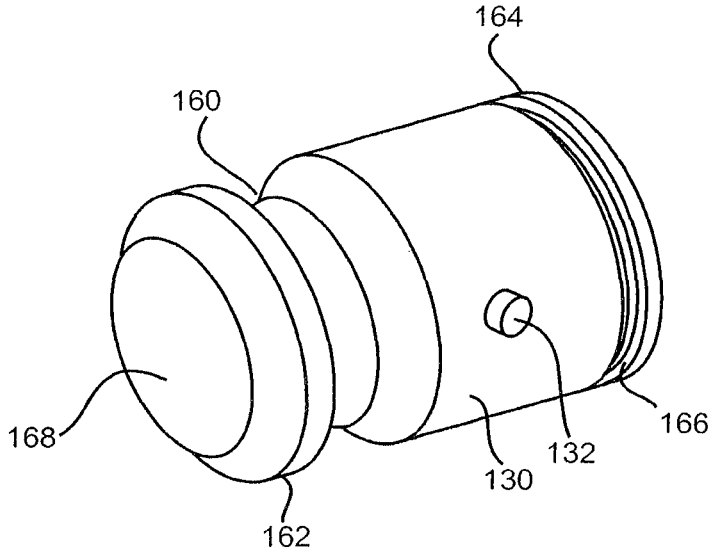
FIGS. 21 and 22 show front and rear perspectives of a piston of the connection means according to the embodiment shown in FIGS. 19 and 20.
Figure 22:
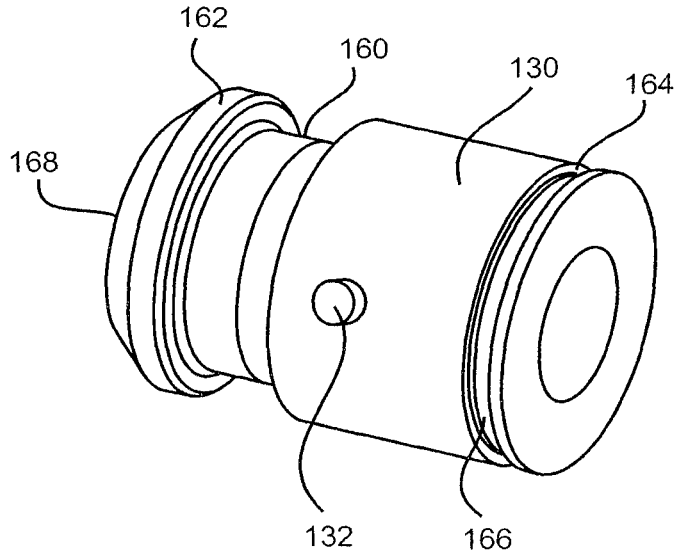

As shown in FIGS. 21 and 22, the piston 130 has an annular recess 160 and an annular projection 162. In use, the annular projection engages over a lip of the boss 170. The boss lip 172 then engages into the recess.

The head end portion 168 of the piston presses against the rear contact face 174 of the boss. The rear portion of the piston includes an annular recess 164 which retains a resilient seal 166 for the piston in the body opening.

The projection 132 is received into a groove 147 in the internal surface of the opening into the body, and prevents the piston rotating when advanced by rotation of the bolt.

Figure 23:
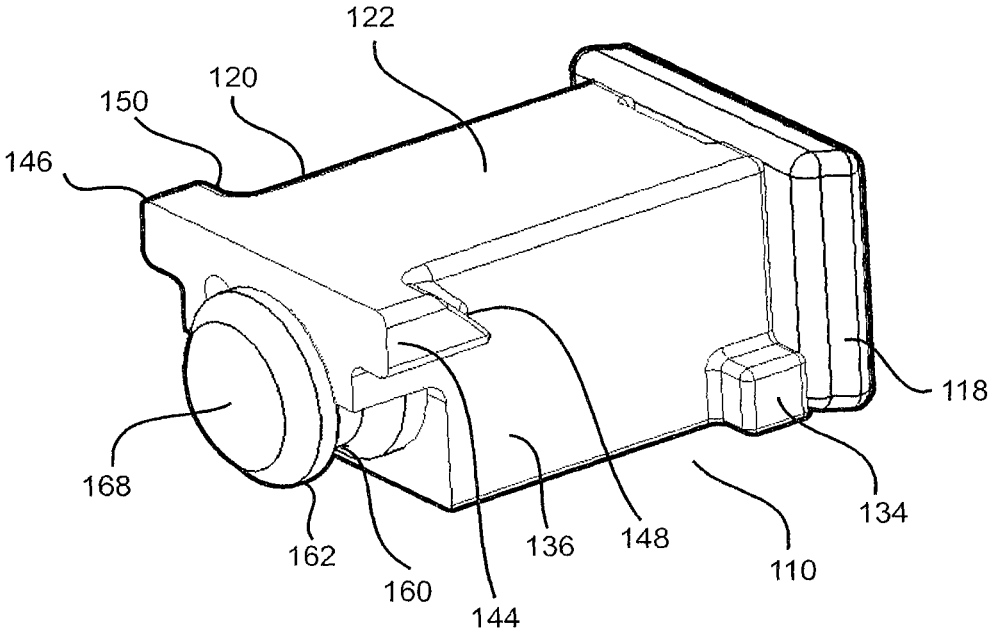
FIG. 23 shows an alternative embodiment of a connection means with piston mounted therein.

FIG. 23 shows an assembled connection means 110 with spacer 118 immediately behind.

Figure 24:
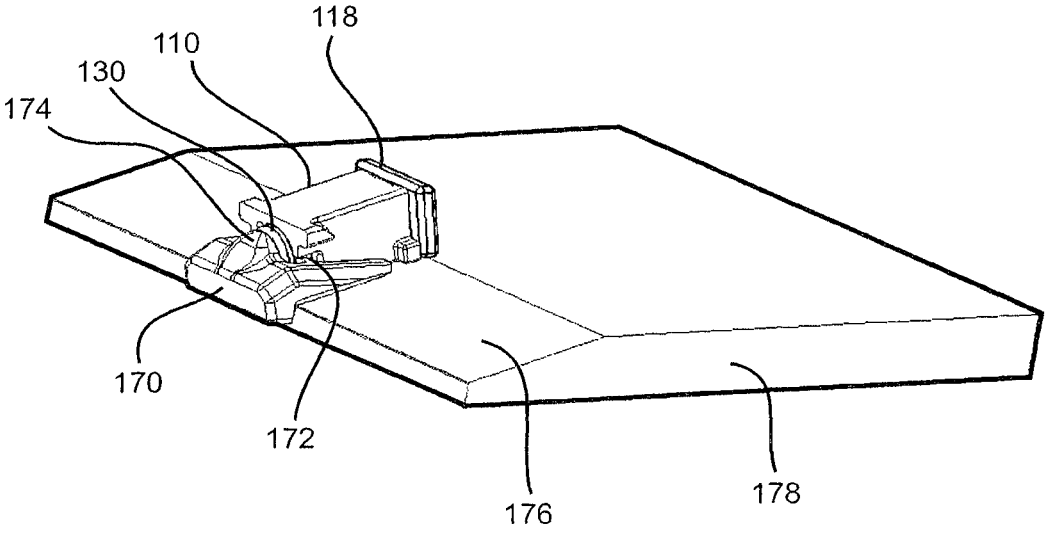
FIG. 24 depicts that connection means mounted to a boss on a front lip of ground engaging equipment.

FIG. 24 shows the connection means 110 mounted in position against a contact face of a boss 170 mounted to an edge lip 176 of a bucket portion 178. The GET is not shown.

Figure 25:
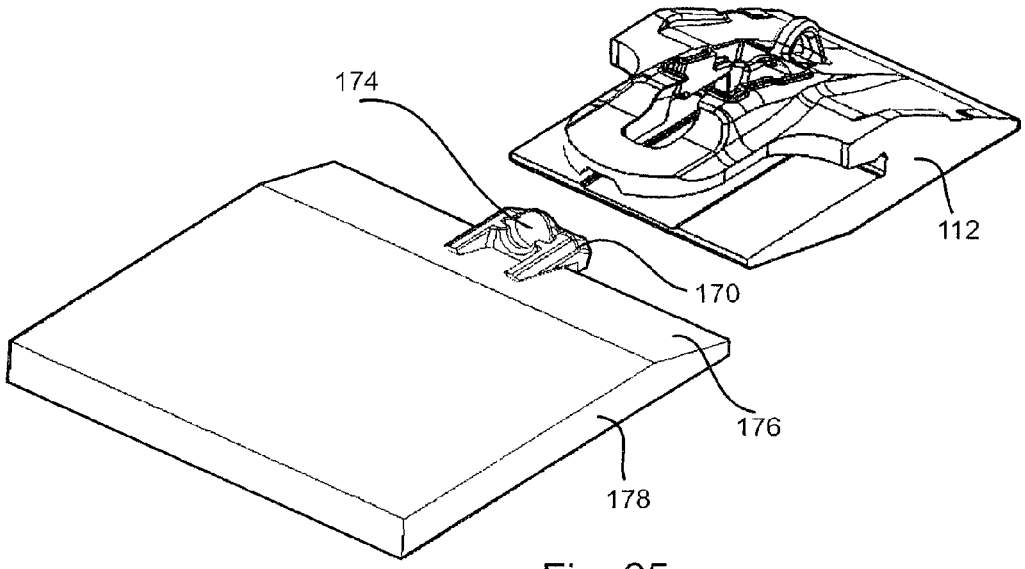
FIGS. 25 and 26 show respective rear and front perspectives of a GET mounting relative to a boss on a front lip of equipment, according to an alternative embodiment of the present invention.
Figure 26:
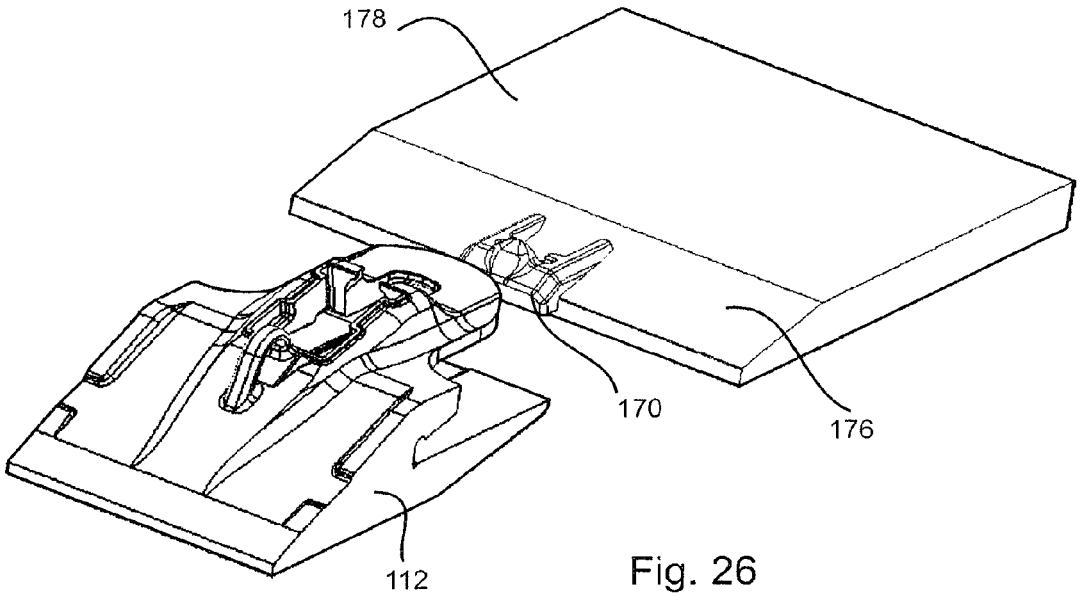

FIGS. 25 to 29 show stages of attaching a GET 112 to the front lip edge 176 of the bucket section 178. In particular, FIGS. 25 and 26 show respective rear and front perspectives of the low profile GET 112 relative to the boss 170 on the front lip edge of the bucket section.

Figure 27:
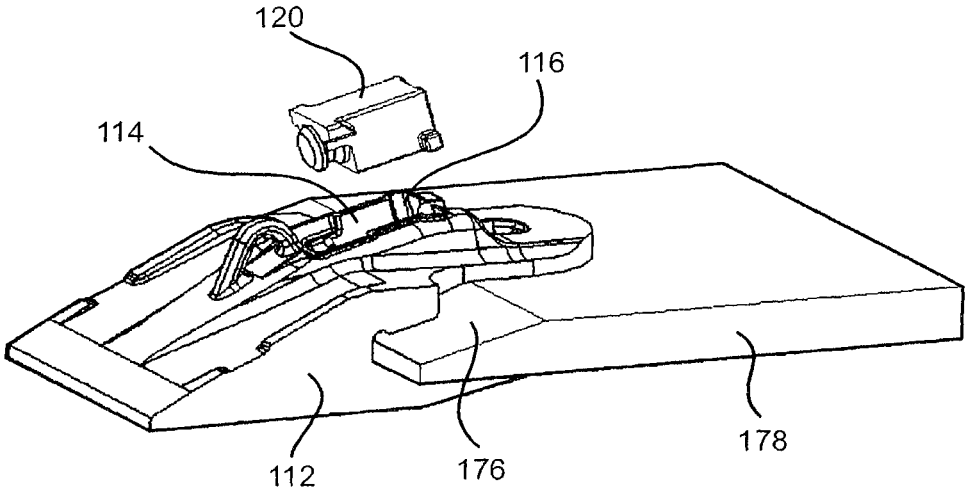
FIG. 27 shows a connection means being inserted into an opening in the top of the GET of FIGS. 25 and 26.
Figure 28:
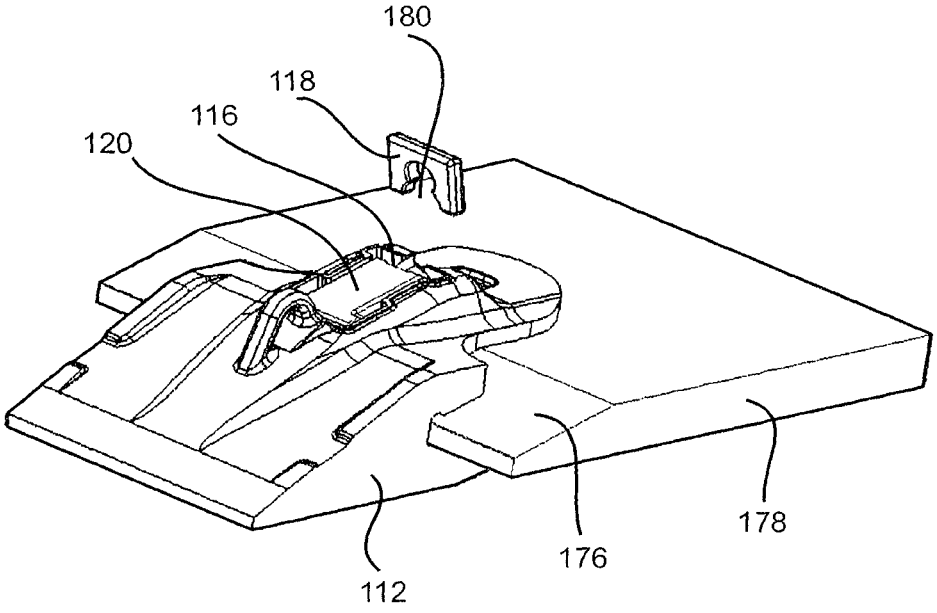
FIG. 28 shows the connection means in position within the GET and a spacer being inserted into an opening behind the connection means prior to tightening the connection means.

FIG. 27 shows the connection means 120 being inserted into the opening 114 in the top of the GET. FIG. 28 shows the connection means 120 positioned in the opening in the GET and the spacer 118 being inserted into the spacer opening 116 behind the connection means that is moved forward within the opening 114. It will be appreciated that the spacer is arch shaped i.e. it has an incomplete boundary 180 around the aperture therethrough to enable the spacer 118 to fit over the surface 162 of the piston 130 during the removal stage.

Figure 29:
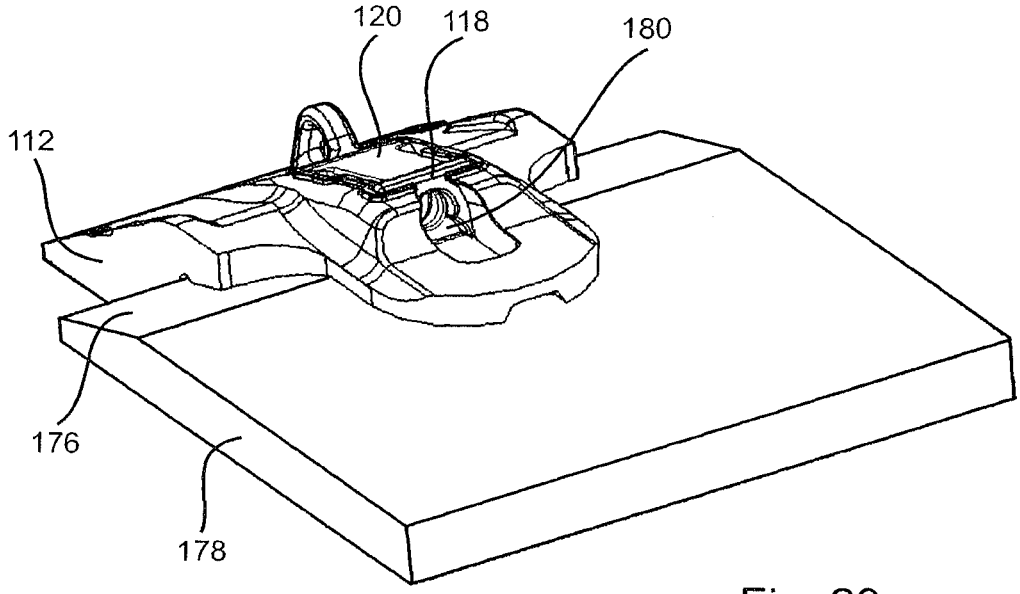
FIG. 29 shows a rear perspective of the GET, connection means and spacer in position, according to an embodiment of the present invention as shown in FIG. 28.

As shown in FIG. 29, the spacer is in position in the spacer opening behind the connection means. The aperture access to the bolt head is clearly shown.

Figure 30:
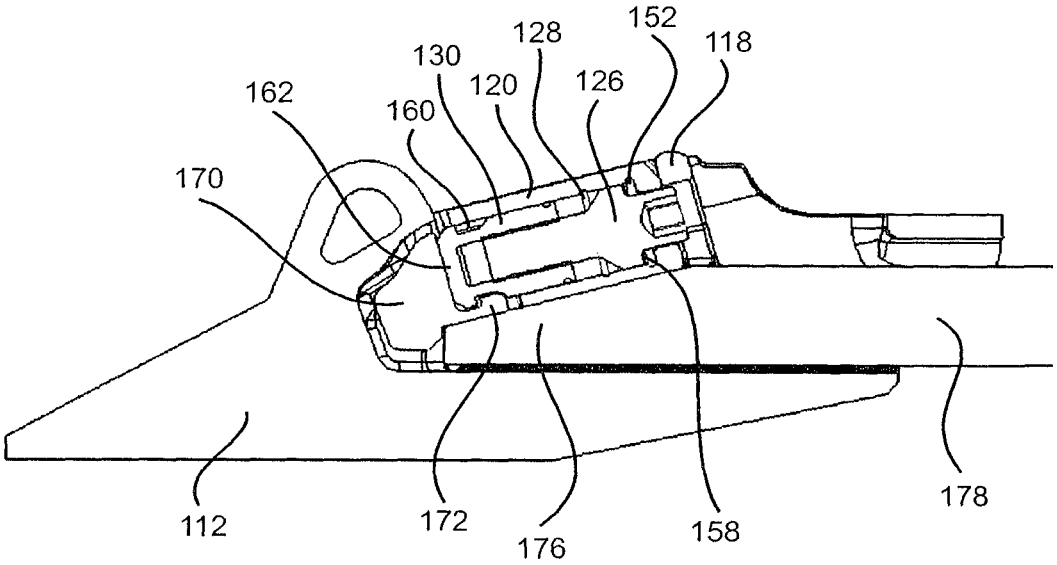
FIGS. 30 to 33 show cross sectional views of steps involved in loosening the connection means and GET to aid in removal of the GET for replacement.

FIG. 30 shows a cross section through the assembled GET and connection means. The connection means is shown tightened up to retain the GET in place. The bolt advances the piston to engage with the inside contact face of the boss. This causes the shoulder of the bolt to push back on the resilient means and thereby force back the body of the connection means to push against the spacer, which thereby forces the spacer to push against the GET and thus retain the GET in place on the boss.

Figure 31:
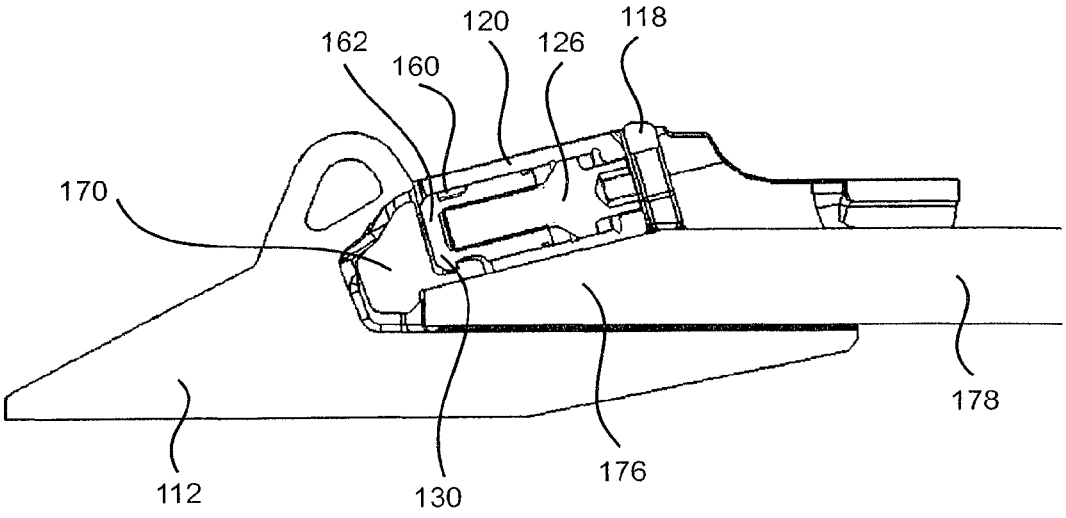
Figure 32:
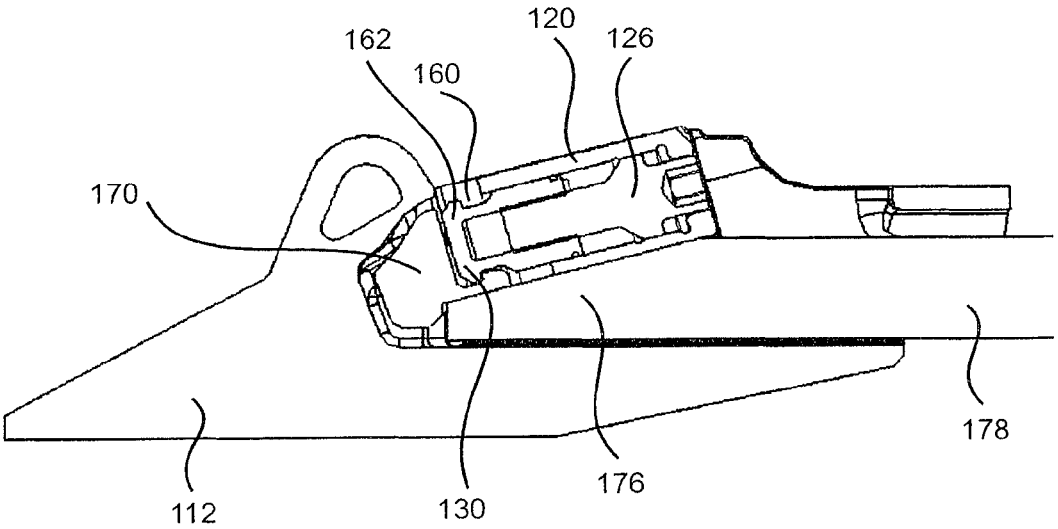

FIG. 31 shows the next step in removing the GET. The bolt is undone and, through its threaded engagement with the bolt, the piston retracts away from contact with the internal contact face of the boss. This takes pressure off the spacer, which allows the spacer to be removed. With the spacer removed, the bolt can then be operated again to extend the piston. As shown in FIG. 32, the piston is extended and the body is rearward and projecting into the spacer opening.

Figure 33:
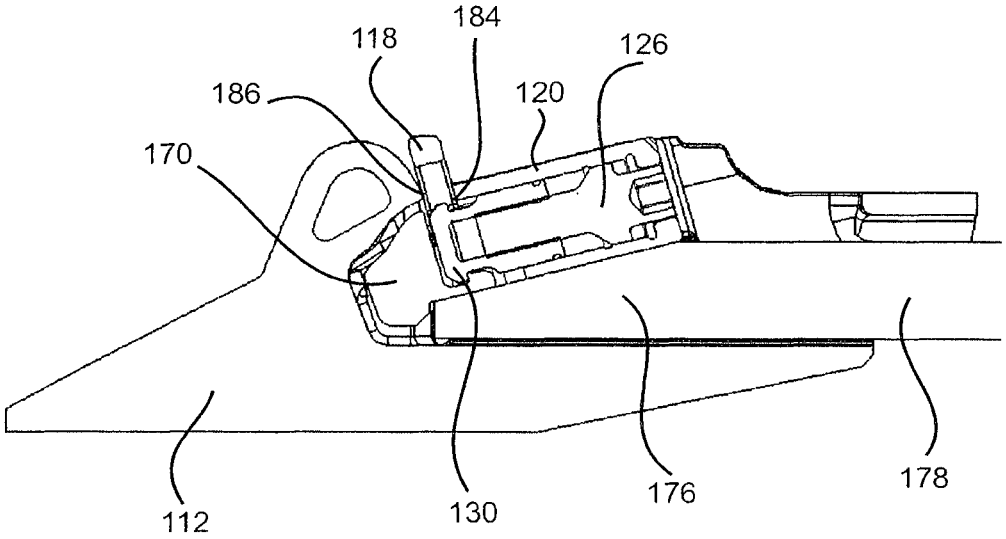
Figure 34:
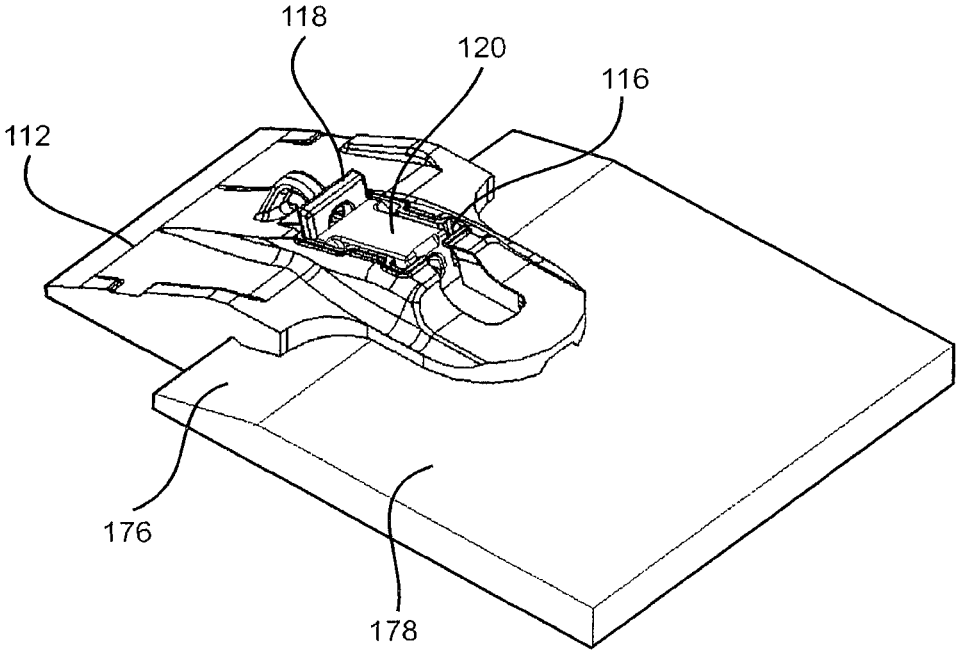
FIG. 34 shows a rear perspective view of the spacer used in the leading opening in front of the connection means to aid in loosening the GET from the lip and boss.

As seen in FIGS. 33 and 34, with the body rearward into the spacer opening (FIG. 31) the spacer is then placed into the gap created between the forward upper face 184 of the body and the edge 186 of the GET 112 at the opening 114. The bolt can then be operated again to retract the piston, which causes the body to advance and contact the spacer. Further operation of the bolt causes the body to apply pressure to the spacer which is trapped against the GET inside edge of the opening. This allows the piston to retract into the body. The spacer and connection means can then be easily removed from the GET and the GET removed from the boss and bucket lip.

The claims defining the invention are as follows:

1. A connection device to attach a ground engaging tool to earthmoving equipment, the device comprising an assembly of a body, a force applying member and a locking member having a first portion, the assembly being received into a recess in the ground engaging tool, wherein, in use, application of force by the force applying member causes a force receiving member to advance relative to the body and thereby to engage the device with a portion of the earthmoving equipment to apply forces to the ground engaging tool and the portion of the earthmoving equipment to connect the ground engaging tool to the earthmoving equipment, the locking member including means to apply a release force to the portion of the earthmoving equipment when releasing the connection device, and a stop arranged to restrict or prevent rotation of the locking member during at least one of actuation and release of the connection device.

2. A connection assembly to releasably attach a ground engaging tool to earth moving equipment, the connection assembly comprising:

a body;

a force applying member; and a locking member, the locking member being arranged to advance relative to the body for the connection assembly to retain the ground engaging tool to the earthmoving equipment and to retract relative to the body when releasing the connection assembly, the locking member including a first portion arranged to positively engage with a boss on the earthmoving equipment when the locking member retracts during a release of the connection assembly and a stop arranged to restrict or prevent rotation of the locking member during at least one of actuation and release of the connection assembly.

3. The connection assembly of claim 1, wherein the locking member is arranged to operatively, retractably release the ground engaging tool from locking engagement with the earthmoving equipment.

4. The connection assembly of claim 1, wherein the earthmoving equipment includes a boss on or adjacent a lip of a bucket of the earthmoving equipment.

5. The connection assembly of claim 1, wherein the first portion of the locking member includes a recess, channel or groove in the locking member creating a projection or lip on the locking member.

6. The connection assembly of claim 5, wherein the locking member projection engages during release of the connection assembly with a contact portion of the boss attached to the earthmoving equipment.

7. The connection assembly of claim 1, wherein the stop means includes at least one stop projection that engages with the body to prevent rotation of the locking member relative to the body.

8. The connection assembly of claim 1, wherein the stop means includes at least one pin or key projecting from the locking member.

9. The connection assembly of claim 1, wherein the force applying member includes a threaded member.

10. The connection assembly of claim 9, wherein the force applying member includes a bolt.

11. The connection assembly of claim 9, wherein the locking member includes a corresponding threaded member for threading engagement with a thread of the threaded force applying member.

12. The connection assembly of claim 1, wherein the locking member includes a nut.

13. The connection assembly of claim 12, wherein the locking member includes a prism body portion selected from the group of a cylindrical, rectangular, hexagonal or octagonal shape.

14. The connection assembly of claim 1, wherein the force applying member includes at least one stop means.

15. The connection assembly of claim 14, wherein the force applying member includes a shoulder or collar to engage with a body stop portion on, within or connected to the body.

16. The connection assembly of claim 14, wherein the body stop portion includes an insert, key, or grub screw that projects to act as a stop for the force applying member.

17. The connection assembly of claim 1, wherein the force applying member is slidably received in the body.

18. The connection assembly of claim 1, wherein the force applying member includes a portion that projects through an aperture of the body when received therein.

19. The connection assembly of claim 1, further comprising at least one resilient member received, in use, between at least one of part of the force applying member and the body and part of the force applying member and part of the force receiving member or locking member.

20. The connection assembly of claim 19, wherein the at least one resilient member includes means to restrict or prevent loosening of the connection assembly due to vibration or impact on the ground engaging tool in use.

21. The connection assembly of claim 1, wherein the connection assembly is a unitary device assembled prior to be being received into a recess of the ground engaging tool.

22. The connection assembly of claim 1, further comprising at least one spacer between the body and a part of the ground engaging tool.

23. The connection assembly of claim 22, wherein the at least one spacer includes an aperture to receive a head of the force applying member.

24. The connection assembly of claim 1, wherein the body includes a recessed end to allow the first portion of the locking member with a channel or recess to project from an end of the body to engage with the boss at least when releasing the connection assembly.

25. The connection assembly of claim 1, wherein the body includes a portion that applies a removal force to the ground engaging tool when the connection assembly is sufficiently un-tightened, the removal force pushing the ground engaging tool away from the boss.

26. Components for releasably attaching a ground engaging tool to earthmoving equipment, the components comprising a connection assembly, the connection assembly including a body, a force applying member, and a locking member, the locking member being arranged to advance relative to the body for the connection assembly to retain the ground engaging tool to the earthmoving equipment and to retract relative to the body when releasing the connection assembly, the locking member including a first portion arranged to positively engage with a boss on the earthmoving equipment when the locking member retracts during a release of the connection assembly, a spacer at a rear of the connection assembly, and a stop arranged to restrict or prevent rotation of the locking member during at least one of actuation and release of the connection assembly.

27. The components according to claim 26, wherein the spacer has an aperture or recess therethrough which allows an actuation tool to be inserted through the spacer to operatively engage with the force applying member, and the spacer providing a release member for insertion between the body and the ground engaging tool to assist in releasing the ground engaging tool from the earthmoving equipment.

28. The components according to claim 27, wherein the recess includes an opening to a periphery of the spacer.

29. A method of releasing a ground engaging tool from earthmoving equipment, the method including the steps of:

providing a connection assembly for releasably attaching the ground engaging tool to the earthmoving equipment, the connection assembly including a body, a force applying member, and a locking member, the locking member being arranged to advance relative to the body for the connection assembly to retain the ground engaging tool to the earthmoving equipment and to retract relative to the body when releasing the connection assembly, the locking member including a first portion arranged to positively engage with a boss on the earthmoving equipment when the locking member retracts during a release of the connection assembly, a spacer at a rear of the connection assembly, and a stop arranged to restrict or prevent rotation of the locking member during at least one of actuation and release of the connection assembly; and releasing the connection assembly releasably attaching the ground engaging tool to the earthmoving equipment, wherein during the releasing the connection assembly positively retracts together the locking member and the body to contract the connection assembly.

30. The method of claim 29, wherein the locking member applies a force to a portion of the earthmoving equipment during the retraction.

31. The method of claim 30, whereby the force is applied to a boss on a lip of a bucket of the earthmoving equipment.

32. The method of claim 29, wherein, during un-tightening of the connection assembly, the connection assembly applies a removal force to the ground engaging tool.

33. The method according to claim 29, the method further comprising:

releasing the force applying member from a force applied state to a force relieved state and at least partially retracting the locking member;

removing a spacer from between the connection assembly and the ground engaging tool;

moving the body to at least partially occupy space created by said removal of the spacer;

at least partially inserting a release member into a space created between the body and the ground engaging tool by moving the body at least partially into the spacer space; and actuating the force applying member to at least partially retract the locking member into the body and, by relative movement of the locking member with respect to the body, cause the body to apply pressure via the release member to the ground engaging tool to assist in releasing the ground engaging tool from the earthmoving equipment.

34. The method according to claim 33, further comprising actuating the force applying member to allow the locking member, which is engaged with a portion of the boss, to retract into the body, such that the locking member and body move relative to one another, and with the locking member engaged with the boss, the body moves forward to apply pressure to the release member inserted between the body and the rear face of the opening in the ground engaging tool ahead of the body to allow the body to push the ground engaging tool.

35. The method according to claim 33, wherein the insertion of the release member in the space between the body and the ground engaging tool assists in removing the ground engaging tool from the earthmoving equipment.

* * * * *